US012612870B2

(12) United States Patent
Qiu et al.

(10) Patent No.: US 12,612,870 B2
(45) Date of Patent: Apr. 28, 2026

(54) ROBUST CONTROL SYSTEMS AND METHODS OF CATALYST TEMPERATURE STABILITY WITH HEATER ASSISTANCE

(71) Applicant: Cummins Inc., Indianapolis, IN (US)

(72) Inventors: Liu Qiu, Columbus, IN (US); Andrew W. Osburn, Nashville, IN (US); Kenneth M. Follen, Greenwood, IN (US); Anant Puri, Greenwood, IN (US); Jeffrey David Selwyn Diwakar Abraham, Columbus, IN (US); Sourav Pramanik, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 18/854,950

(22) PCT Filed: Apr. 7, 2023

(86) PCT No.: PCT/US2023/017956
§ 371 (c)(1),
(2) Date: Oct. 7, 2024

(87) PCT Pub. No.: WO2023/196644
PCT Pub. Date: Oct. 12, 2023

(65) Prior Publication Data

US 2025/0250919 A1 Aug. 7, 2025

Related U.S. Application Data

(60) Provisional application No. 63/329,301, filed on Apr. 8, 2022.

(51) Int. Cl.
*F01N 3/20* (2006.01)
*F01N 3/10* (2006.01)

(52) U.S. Cl.
CPC ..... *F01N 3/2066* (2013.01); *F01N 3/103* (2013.01); *F01N 3/2006* (2013.01);
(Continued)

(58) Field of Classification Search
CPC ..... F01N 3/103; F01N 3/2066; F01N 3/2006; F01N 11/002
See application file for complete search history.

(56) References Cited

U.S. PATENT DOCUMENTS 5,600,947 A 2/1997 Cullen
7,818,960 B2 10/2010 Gonze et al.
(Continued)

FOREIGN PATENT DOCUMENTS

EP 1 898 061 A1 3/2008
JP 5159739 B2 3/2013
JP 2022-057402 A 4/2022

OTHER PUBLICATIONS

PCT International Preliminary Report on Patentability for PCT/US2023/017956, dated Oct. 17, 2024.
(Continued)

*Primary Examiner* — Ngoc T Nguyen
(74) *Attorney, Agent, or Firm* — Foley & Lardner LLP

(57) ABSTRACT

A system includes an exhaust aftertreatment system and a controller including a processor coupled to a memory device storing instructions that, when executed by the at least one processor, cause the controller to perform operations. The operations include receiving sensor data comprising a diesel oxidation catalyst inlet temperature, a selective catalytic reduction system inlet temperature, and exhaust flow data; determining outer loop feedback data based on a target SCR temperature, and the SCR inlet temperature; determining inner loop feedback data based on the outer loop feedback data and the SCR inlet temperature; determining inner loop
(Continued)

feedforward data based the outer loop feedback data, the DOC inlet temperature, and the exhaust flow data; determining heater control data based on the inner loop feedback data and the inner loop feedforward data; and causing the heater to operate in a stable manner while maintaining a stead desired temperature target.

20 Claims, 5 Drawing Sheets

(52) U.S. Cl.
CPC ..... *F01N 2560/06* (2013.01); *F01N 2560/14* (2013.01); *F01N 2900/0602* (2013.01); *F01N 2900/1602* (2013.01)

(56) References Cited

U.S. PATENT DOCUMENTS

| | | | |
|---|---|---|---|
| 8,473,177 | B2 | 6/2013 | Madurai Kumar et al. |
| 9,708,945 | B2 | 7/2017 | Zhang et al. |
| 10,288,017 | B1 | 5/2019 | Romanato |
| 2006/0276956 | A1 | 12/2006 | Johnson |
| 2019/0155230 | A1 | 5/2019 | Culbertson et al. |
| 2021/0301700 | A1 | 9/2021 | Brahma |

OTHER PUBLICATIONS

PCT International Search Report and Written Opinion dtd Jul. 27, 2023 re PCT/US2023/017956.

ROBUST CONTROL SYSTEMS AND METHODS OF CATALYST TEMPERATURE STABILITY WITH HEATER ASSISTANCE

CROSS-REFERENCE TO RELATED APPLICATIONS

This application is a U.S. National Stage Application of International Application No. PCT/US2023/017956, filed Apr. 7, 2023, which claims the benefit of and priority to U.S. Provisional Patent Application No. 63/329,301, filed Apr. 8, 2022, titled "ROBUST CONTROL SYSTEMS AND METHODS OF CATALYST TEMPERATURE STABILITY WITH HEATER ASSISTANCE," both of which are incorporated herein by reference in their entireties and for all purposes.

TECHNICAL FIELD

The present disclosure relates to systems and methods for managing aftertreatment systems or components thereof, such as catalysts, using an onboard controller.

BACKGROUND

Many engines are coupled to exhaust aftertreatment systems that reduce harmful exhaust gas emissions (e.g., nitrous oxides (NOx), sulfur oxides, particulate matter, etc.). A reductant may be injected into the exhaust stream to chemically bind to particles in the exhaust gas. This mixture interacts with a Selective Catalytic Reduction (SCR) catalyst that, at a certain temperature, causes a reaction in the mixture that converts the harmful NOx particles into pure nitrogen and water. Changes in engine operating conditions, such as ambient temperature, operating load, and/or other factors may cause the temperature within the exhaust aftertreatment system to change over time thereby affecting the ability of the aftertreatment system to reduce harmful emissions.

SUMMARY

One embodiment relates to a system. The system includes an exhaust aftertreatment system coupled to an engine. The exhaust aftertreatment system includes a selective catalytic reduction (SCR) system, a diesel oxidation catalyst (DOC), and a heater. The system also includes a controller comprising at least one processor coupled to at least one memory device storing instructions that, when executed by the at least one processor, cause the controller to perform operations including: receiving, from one or more sensors, sensor data comprising a DOC inlet temperature, a SCR inlet temperature, and exhaust flow data; executing a first control process specific to a first set of components of the exhaust aftertreatment system, the first control process includes determining a first control process output based on at least the sensor data, executing a second control process specific to a second set of components of the exhaust aftertreatment system, the second control process includes determining a heater control output based on at least one of the first control process output or the sensor data; and causing the heater to operate in a stable manner while maintaining a stead desired temperature target.

Another embodiment relates to a method. The method includes: receiving, by a controller, sensor data comprising at least one of a diesel oxidation catalyst (DOC) inlet temperature, a selective catalytic reduction (SCR) inlet temperature, or exhaust flow data; executing, by the controller, a first control process specific to a first set of components of an exhaust aftertreatment system, the first control process comprising determining a first control process output based on at least the SCR inlet temperature; executing, by the controller, a second control process specific to a second set of components of the exhaust aftertreatment system, the second control process comprising determining a heater control output based on at least one of the first control process output or the sensor data; and causing, by the controller, a heater to operate based on the heater control output relative to a target SCR temperature. In some embodiments, the controller is included in a vehicle.

Yet another embodiment relates to a non-transitory computer-readable medium storing instructions that, when executed by at least one processor of a controller, cause the controller to perform operations comprising: receiving sensor data comprising a diesel oxidation catalyst (DOC) inlet temperature, a selective catalytic reduction (SCR) inlet temperature, and exhaust flow data; executing a first control process regarding a first set of components of an exhaust aftertreatment system, the first control process comprising determining a first control process output based on at least the SCR inlet temperature; executing a second control process regarding a second set of components of the exhaust aftertreatment system, the second control process comprising determining a heater control output based on at least one of the first control process output or the sensor data; and causing a heater to operate based on the heater control output according to a target SCR temperature.

This summary is illustrative only and is not intended to be in any way limiting. Other aspects, features, and advantages of the devices or processes described herein will become apparent in the detailed description set forth herein, taken in conjunction with the accompanying figures, wherein like reference numerals refer to like elements. Numerous specific details are provided to impart a thorough understanding of embodiments of the subject matter of the present disclosure. The described features of the subject matter of the present disclosure may be combined in any suitable manner in one or more embodiments and/or implementations. In this regard, one or more features of an aspect of the invention may be combined with one or more features of a different aspect of the invention. Moreover, additional features may be recognized in certain embodiments and/or implementations that may not be present in all embodiments or implementations.

DETAILED DESCRIPTION

Figure 1:
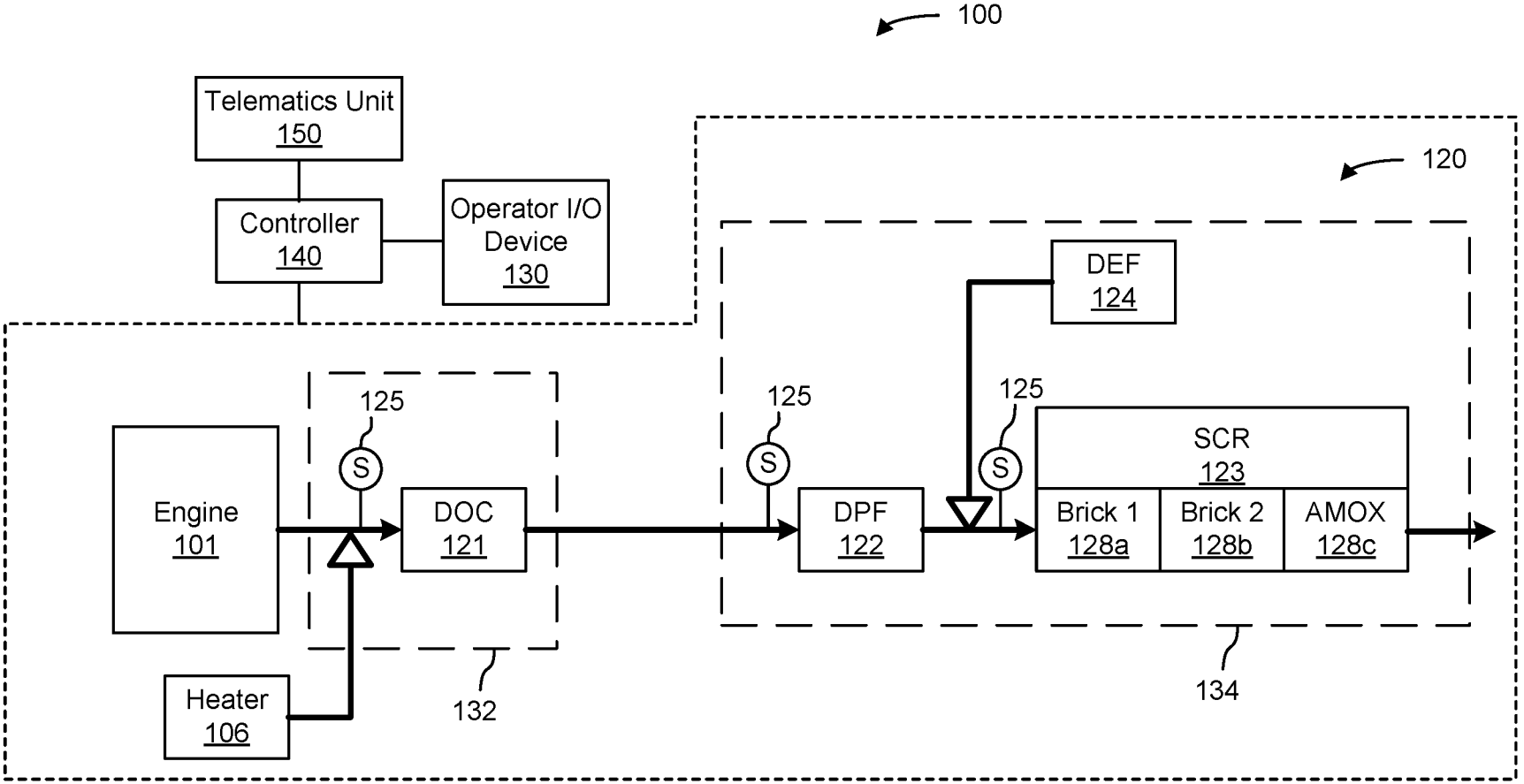
FIG. 1 is a schematic view of a block diagram of a vehicle system, according to an example embodiment.

Following below are more detailed descriptions of various concepts related to, and implementations of, methods, apparatuses, and systems to control a temperature of an exhaust aftertreatment system and/or components thereof such as a catalyst. Before turning to the Figures, which illustrate certain exemplary embodiments in detail, it should be understood that the present disclosure is not limited to the details or methodology set forth in the description or illustrated in the Figures. It should also be understood that the terminology used herein is for the purpose of description only and should not be regarded as limiting.

As described herein, an exhaust gas aftertreatment system may include a heater to actively increase a temperature of the exhaust aftertreatment system. Additionally, a control system or controller may provide commands to increase an exhaust gas temperature thereby increasing the temperature of one or more components in the exhaust gas aftertreatment system by operating the heater. The controller may generate the commands based on sensor data received from one or more sensors.

As further described herein, systems, methods, apparatuses for robust control of catalyst temperature stability with heater assistance are disclosed according to various embodiments. The control systems described herein advantageously utilize a particular control strategy to improve temperature stability within an exhaust aftertreatment system or of a component thereof. An example control system utilizes a plurality of control processes to control the temperature of the exhaust aftertreatment system. In some embodiments, the plurality of control processes includes a nested control process, such as a dual loop control process having a first control process (e.g., a combination of feedback and feedforward control processes) to generate a control target for the second control process and the second control process (e.g., a combination of feedback and feedforward control processes) for controlling the temperature of the exhaust aftertreatment system. The benefit of the two control processes (i.e. "dual loop" control process) is such that the first control process (i.e., an "outer loop") can run slower and generate the target for the faster running second control process (i.e., an "inner loop"). The plurality of control processes advantageously controls the temperature to a predetermined target temperature such that the exhaust aftertreatment system does not operate at a temperature that is too low (thereby reducing the efficacy of the aftertreatment system) or a temperature that is too high (thereby expending excess energy or consuming excess fuel than is required for controlling the temperature of the aftertreatment system). In some embodiments, the predetermined target temperature may be determined based on one or more factors including an ambient temperature, an engine or powertrain load, a target NOx conversion rate (e.g., based on an emissions goal and/or a regulation) and/or other factors. In some embodiments, the predetermined target temperature may be determined based on a signal from a different control system, such as an aftertreatment dosing controller, a heater controller, an engine control unit/module (ECU/ECM), etc. In other embodiments, the target temperature is based on at least one of a user input, a lookup table, a statistical model, and/or a machine learning model (e.g., artificial intelligence). The target temperature may be dynamically updated, as needed and/or desired.

In an example operating scenario, a control system (e.g., a controller, an engine control module, vehicle controller area network bus, etc.) utilizes a plurality of control processes, such as a dual loop control process, to operate an exhaust aftertreatment system heater. The control system operates an exhaust aftertreatment heater to adjust the temperature of the aftertreatment system (e.g., by heating exhaust gasses) and/or a component thereof to the target temperature. Over time, the temperature of the exhaust gases, the aftertreatment system and/or a component thereof reaches the target temperature. The control system advantageously maintains the desired exhaust aftertreatment system temperature for a desired nitrogen oxide removal (i.e., DeNOx) efficiency while also considering the fueling and drivability impact. For example, the control system maintains the aftertreatment system at the target temperature robustly and stably so as to maintain the target temperature at the target temperature, at which the catalyst deNOx efficiency is the most desired. Furthermore, the control system may modulate the heater power/operations to reduce extra power (fueling) or emissions (e.g. NOx).

Referring now to FIG. 1, a system 100 is illustrated, according to an exemplary embodiment. The system 100 includes an engine 101, an aftertreatment system 120 coupled to the engine 101, an operator I/O device 130, a controller 140, and a telematics unit 150, where the controller 140 is communicably coupled to each of the aforementioned components. The telematics unit 150 facilitates the acquisition and transmission of data acquired regarding the operation of the system 100. According to one embodiment, the system 100 is embodied in a vehicle. In various alternate embodiments, the system 100 may be implemented in a non-vehicular application (e.g., a power generator or gen-set). In the example shown, the system 100 is embodied in a vehicle. The vehicle may be an on-road or an off-road vehicle including, but not limited to, line-haul trucks, mid-range trucks (e.g., pick-up trucks), sedans, coupes, tanks, airplanes, boats, and any other type of vehicle that utilizes an exhaust aftertreatment system and, particularly, diesel aftertreatment system with a DOC, DPF, and SCR with electrical heaters (pre-DOC or pre-DPF for instance).

In the example shown, the engine 101 is structured as a compression-ignition internal combustion engine that utilizes diesel fuel. However, in various alternate embodiments, the engine 101 may be structured as another type of engine (e.g., spark-ignition) that utilizes another type of fuel (e.g., gasoline, natural gas, biodiesel). In still other example embodiments, the engine 101 may be or include an electric motor (e.g., a hybrid vehicle). In regards to a hybrid vehicle, hybrid systems generally include both an electric motor or motors and an internal combustion engine that function to provide power to the drivetrain in order to propel the vehicle. A hybrid vehicle can have various configurations. For example, in a parallel configuration, both the electric motor and the internal combustion engine are operably connected to the drivetrain/transmission to propel the vehicle. In a series configuration, the electric motor is operably connected to the drivetrain/transmission and the internal combustion engine indirectly powers the drivetrain/transmission by powering the electric motor (e.g., extended range electric vehicles or range-extended electric vehicles). In a series-parallel configuration, the hybrid vehicle has features from both the parallel configuration and the series configuration. For example, the internal combustion engine may be operably connected to the drivetrain/transmission to propel the vehicle and power the electric motor. In still other embodiments, the engine may include a fuel-cell powered engine that utilizes hydrogen in conjunction with the diesel-powered engine.

In some embodiments, the engine 101 includes one or more cylinders and associated pistons. Air from the atmosphere is combined with fuel, and combusted, to power the engine 101. Combustion of the fuel and air in the compression chambers of the engine 101 produces exhaust gas that is operatively vented to an exhaust pipe and to the aftertreatment system 120. The engine 101 may be coupled to a turbocharger (not shown). The turbocharger (e.g., variable geometry turbocharger or another turbocharger) includes a compressor coupled to an exhaust gas turbine via a connector shaft. Generally, hot exhaust gasses spin the turbine which rotates the shaft and in turn, the compressor, which draws air in. By compressing the air, more air can enter the cylinders, or combustion chamber, thus burning more fuel and increasing power and efficiency. A heat exchanger, such as a charge air cooler, may be used to cool the compressed air before the air enters the cylinders. In some embodiments, the turbocharger is omitted.

The aftertreatment system 120 is shown, according to an example embodiment. It should be understood that the schematic depicted in FIG. 1 is but one implementation of an exhaust gas aftertreatment system architecture. Many different configurations may be implemented that utilize the systems and methods described herein.

The aftertreatment system 120 is coupled to the engine 101, and is structured to treat exhaust gases from the engine 101, which enter the aftertreatment system 120 via an exhaust pipe, in order to reduce the emissions of harmful or potentially harmful elements (e.g., NOx emissions, particulate matter, SOx, greenhouse gases, CO, etc.). The aftertreatment system 120 may include various components and systems, such as a diesel oxidation catalyst (DOC) 121, a diesel particulate filter (DPF) 122, and a selective catalytic reduction (SCR) system 123. The SCR system 123 converts nitrogen oxides present in the exhaust gases produced by the engine 101 into diatomic nitrogen and water through oxidation within a catalyst. The DOC 121 is configured to oxidize hydrocarbons and carbon monoxide in the exhaust gases flowing in the exhaust gas conduit system. The DPF 122 is configured to remove particulate matter, such as soot, from exhaust gas flowing in the exhaust gas conduit system. In some implementations, the DPF 122 may be omitted. In some embodiments, the spatial order of the catalyst elements may be different.

In the example depicted, the SCR system 123 includes a first brick 128(*a*), a second brick 128(*b*), and an ammonia oxidation (AMOX) catalyst shown as AMOX 128(*c*). The first brick 128(*a*) and/or the second brick 128(*b*) is configured as a selective catalytic reduction (SCR) catalyst. The SCR system 123 is configured to convert nitrogen oxides present in the exhaust gases produced by the engine 101 into diatomic nitrogen and water through oxidation within a catalyst. Referring first to the first brick 128(*a*) and/or the second brick 128(*b*), the first brick 128(*a*) and/or the second brick 128(*b*) may be any of various catalysts known in the art. For example, in some embodiments, the first brick 128(*a*) and/or the second brick 128(*b*) may be a vanadium-based catalyst, and in other embodiments, the first brick 128(*a*) and/or the second brick 128(*b*) is a zeolite-based catalyst, such as a Cu-Zeolite or a Fe-Zeolite catalyst. Although the SCR system 123 is shown to include both the first brick 128(*a*) and the second brick 128(*b*), in some embodiments, the SCR system 123 includes more or fewer bricks (e.g., at least one brick).

The AMOX 128(*c*) may be any of various flow-through catalysts structured to react with ammonia to produce mainly nitrogen. The AMOX 128(*c*) is structured to remove ammonia that has slipped through or exited the first brick 128(*a*) and/or the second brick 128(*b*) without reacting with NOx in the exhaust gas. In certain instances, the exhaust aftertreatment system 120 may be operable with or without the AMOX 128(*c*). Further, although the AMOX 128(*c*) is shown within the SCR in FIG. 1, in some embodiments, the AMOX 128(*c*) may be separate from the SCR 123, e.g., the AMOX 128(*c*) and the first brick 128(*a*) and/or the second brick 128(*b*) can be located within different housings. In still other embodiments, the AMOX 128(*c*) may be excluded from the exhaust aftertreatment system 120.

Operation of the SCR system 123 can be affected by several factors. For example, the effectiveness of the SCR catalyst to reduce the NOx in the exhaust gas can be affected by the operating temperature. If the temperature of the SCR catalyst is below a threshold value or range, the effectiveness of the SCR catalyst in reducing NOx may be reduced below a desired threshold level, thereby increasing the risk of high NOx emissions into the environment. The SCR catalyst temperature can be below the threshold temperature under several conditions, such as, for example, during and immediately after engine startup, during cold environmental conditions, etc. In operation, typically, higher combustion temperatures promote engine out NOx (EONOx) production. Increasing exhaust gas recirculation (EGR) leads to reduction in combustion temperatures, which reduces EONOx. However, EGR can promote particulate matter emissions due to incomplete combustion of particles. Additionally, higher loads and power demands also tend to increase combustion temperatures and, in turn, EONOx. Higher power output coincides with higher fueling pressures and quantity (increases in fuel rail pressure). In turn, increasing fueling pressures, quantity, etc. also tends to promote EONOx production. The effectiveness of the SCR catalyst can also be affected by faults in the SCR system that indicate, for example, a lack of reductant, a build-up on the SCR catalyst, a sustained conversion efficiency below a predefined value (e.g., a NOx conversion efficiency), etc.

The aftertreatment system 120 may further include a reductant delivery system which may include a decomposition chamber (e.g., decomposition reactor, reactor pipe, decomposition tube, reactor tube, etc.) to convert the reductant (e.g., urea, diesel exhaust fluid (DEF), Adblue®, a urea water solution (UWS), an aqueous urea solution, etc.) into ammonia. Reductant 124 is added to the exhaust gas stream to aid in the catalytic reduction. The reductant may be injected by an injector upstream of the SCR catalyst member such that the SCR catalyst member receives a mixture of the reductant and exhaust gas. The reductant droplets undergo the processes of evaporation, thermolysis, and hydrolysis to form non-NOx emissions (e.g., gaseous ammonia, etc.) within the decomposition chamber, the SCR catalyst member (e.g., the first brick 128(*a*) and/or the second brick 128(*b*)), and/or the exhaust gas conduit system, which leaves the aftertreatment system 120.

The aftertreatment system 120 may further include an oxidation catalyst (e.g., the DOC 121) fluidly coupled to the exhaust gas conduit system to oxidize hydrocarbons and carbon monoxide in the exhaust gas. In order to properly assist in this reduction, the DOC 121 may be required to be at a certain operating temperature. In some embodiments, this certain operating temperature is between 200 degrees C. and 500 degrees C. In other embodiments, the certain operating temperature is the temperature at which the conversion efficiency of the DOC 121 exceeds a predefined threshold.

As shown, a plurality of sensors 125 are included in the aftertreatment system 120. The number, placement, and type of sensors included in the aftertreatment system 120 is shown for example purposes only. That is, in other configurations, the number, placement, and type of sensors may differ. The sensors 125 may be NOx sensors, temperature sensors, particulate matter (PM) sensors, flow rate sensors, other emissions constituents sensors, pressure sensors, some combination thereof, and so on. The NOx sensors are structured to acquire data indicative of a NOx amount at each location that the NOx sensor is located (e.g., a concentration amount, such as parts per million). The temperature sensors are structured to acquire data indicative of a temperature at their locations. The PM sensors are structured to monitor particulate matter flowing through the aftertreatment system 120.

The sensors 125 may be located after the engine 101 and before the aftertreatment system 120, after the aftertreatment system 120, and in the aftertreatment system as shown (e.g., coupled to the DPF and/or DOC, coupled to the SCR, etc.). It should be understood that the location of the sensors may vary. In one embodiment, there may be sensors 125 located both before and after the aftertreatment system 120. In one embodiment, at least one of the sensors is structured as exhaust gas constituent sensors (e.g., CO, NOx, PM, SOx, etc. sensors). In another embodiment, at least one of the sensors 125 is structured as non-exhaust gas constituent sensors that are used to estimate exhaust gas emissions (e.g., temperature, flow rate, etc.). Additional sensors may be also included with the system 100. The sensors may include engine-related sensors (e.g., torque sensors, speed sensors, pressure sensors, flow rate sensors, temperature sensors, etc.). The sensors may further sensors associated with other components of the vehicle (e.g., speed sensor of a turbo charger, fuel quantity and injection rate sensor, fuel rail pressure sensor, etc.).

The sensors may be real or virtual (i.e., a non-physical sensor that is structured as program logic in the controller 140 that makes various estimations or determinations). For example, an engine speed sensor may be a real or virtual sensor arranged to measure or otherwise acquire data, values, or information indicative of a speed of the engine 101 (typically expressed in revolutions-per-minute). The sensor is coupled to the engine (when structured as a real sensor), and is structured to send a signal to the controller 140 indicative of the speed of the engine 101. When structured as a virtual sensor, at least one input may be used by the controller 140 in an algorithm, model, lookup table, etc. to determine or estimate a parameter of the engine (e.g., power output, etc.). Any of the sensors 125 described herein may be real or virtual.

The controller 140 is communicably coupled to the sensors 125. Accordingly, the controller 140 is structured to receive data from one more of the sensors 125. The received data may be used by the controller 140 to control one more components in the system 100 and/or for monitoring and diagnostic purposes.

The heater 106 is a heating element or unit structured to output heat in order to increase the temperature of the exhaust gas and/or a component of the exhaust aftertreatment system. The heater 106 may have any of various designs (e.g., a resistive coil heater, or another type of heater). The heater 106 may be a convective heater to heat the exhaust gas passing through it or to heat the aftertreatment system (or a component thereof) directly. For example, the heater 106 may heat a substrate of the first brick 128(*a*) and/or the second brick 128(*b*) directly. The heater 106 may be powered by a battery and/or alternator (or another electronic source, such as a capacitor) of the system 100. Heating the exhaust gas increases efficiency and the success of the DOC 121 and/or the SCR 123 in cold situations (e.g., ambient temperatures at or below the freezing temperature of water). The heater 106 is controlled by the controller 140 to adjust the operation of the heater 106 (e.g., turning the heater on, off, or at a particular operating power, temperature, or duty cycle) as further described below. When the heater 106 is "on" or "activated," the heater 106 outputs heat, and when the heater 106 is "off" or "deactivated," the heater 106 ceases heat output. When the heater 106 is on, the heater may be operated in a range of temperature or power settings based on a control signal, command, etc. from the controller 140 either directly, or indirectly (e.g., via a heater control unit).

As shown in the embodiment FIG. 1, the heater 106 is positioned downstream from the engine 102 and upstream of the DOC 121 (i.e., between the engine 102 and the DOC 121) in order to heat the air leaving the engine 101 and entering the DOC 121. The heater 106 is coupled to the exhaust pipe that leads from the engine 101 to the aftertreatment system 120. In other embodiments, the heater 106 may be positioned in other locations, such as between the DOC 121 and the DPF 122 and/or between the DPF 122 and the SCR 123. In some embodiments, the aftertreatment system 120 may include one or more additional heaters (e.g., in addition to the heater 106). The one or more additional heaters may be positioned downstream from the engine 102 and upstream of the DOC 121 or another location, such as between the DOC 121 and the DPF 122 and/or between the DPF 122 and the SCR 123.

Figure 2:
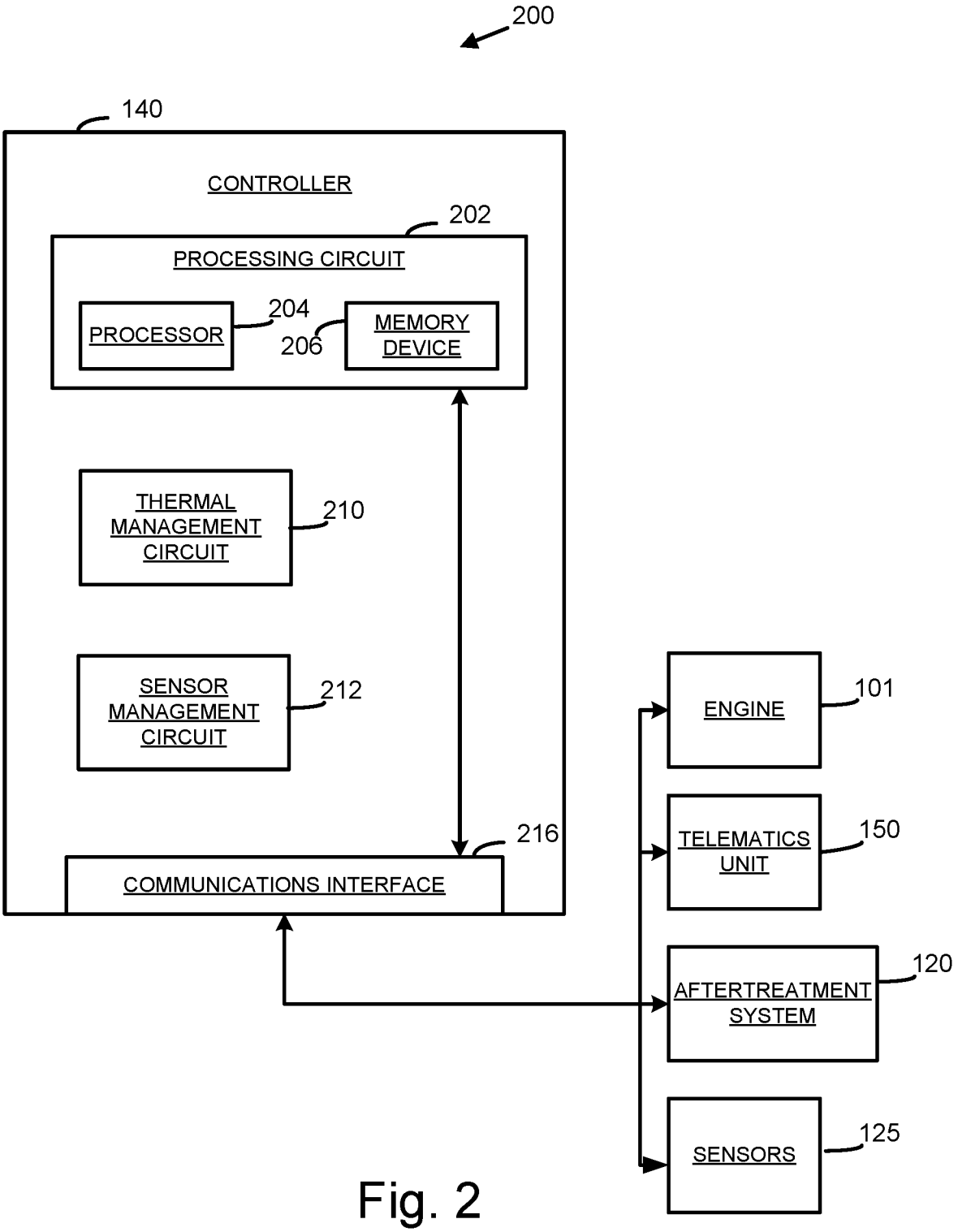
FIG. 2 is a block diagram of the controller of FIG. 1, according to an example embodiment.

In some embodiments, the heater 106 may include a heater control unit (not shown) for controlling the operation of the heater 106. The heater control unit may be contained within the heater 106 and/or at least partially geographically remote from the heater 106. In some embodiments, the heater control unit is at least partially provided as part of the controller 140. For example, and as shown in FIG. 2, the heater control unit may be part of the thermal management circuit 210. In other embodiments, the heater control unit is separate from the controller 140. In these embodiments, the controller 140 and/or the thermal management circuit 210 may communicate (e.g., via the communications interface 216) with the heater control unit to control the operation the heater 106.

The components of the aftertreatment system 120 are grouped into a plurality of control groups or processes, shown as having two sections that define two control loops shown as a first control loop (referred to herein as an inner loop 132) and a second control loop (referred to herein as an outer loop 134). As shown in FIG. 1 the inner loop 132 includes the DOC 121 and at least one sensor 125. The controller 140 may receive information (e.g., temperature data) from the inner loop 132, or more specifically from the sensor 125 in the inner loop 132. The temperature data received from the inner loop 132 includes a temperature of the exhaust gasses at the inlet of the DOC 121 (referred to herein as "DOC Tin"). In other embodiments, the DOC Tin may refer to a temperature of the DOC 121 at an inlet of the DOC 121. As shown, a sensor 125 is downstream of the heater 106. Accordingly, DOC Tin is related to the output temperature of the heater 106. As shown in FIG. 1 the outer loop 134 includes the DPF 122, the SCR 123, the DEF 124, and one or more sensors 125. The controller 140 may receive sensor data from the outer loop 134, or more specifically from the sensor 125 in the outer loop 134. The sensor data received from the outer loop 134 includes a temperature of the exhaust gasses at the outlet of the DOC 121 (referred to herein as "DOC Tout"). In other embodiments DOC Tout is a temperature of the DOC 121 at an outlet of the DOC 121. The DOC Tout is also the inlet temperature of the DPF 122. The temperature data received from the outer loop 134 also includes a temperature of the exhaust gasses at the inlet of the SCR 123 (referred to herein as "SCR Tin"). In other embodiments, the SCR Tin is a temperature of the SCR 123 at an inlet of the SCR 123. The SCR Tin is also the outlet temperature of the DPF 122. In some embodiments (e.g., when the aftertreatment system does not include the DPF 122), the DOC Tout is substantially similar to the SCR Tin, such that the DOC Tout may be used interchangeable with the SCR Tin.

Referring still to FIG. 1, an operator input/output (I/O) device 130 is also shown. The operator I/O device 130 may be communicably coupled to the controller 140, such that information may be exchanged between the controller 140 and the I/O device 130, wherein the information may relate to one or more components of FIG. 1 or determinations (described below) of the controller 140. The operator I/O device 130 enables an operator (e.g., a user) of the system 100 to communicate with the controller 140 and one or more components of the system 100 of FIG. 1. For example, the operator input/output device 130 may include, but is not limited to, an interactive display, a touchscreen device, one or more buttons and switches, voice command receivers, etc. In various alternate embodiments as described above, the controller 140 and components described herein may be implemented with non-vehicular applications (e.g., a power generator). Accordingly, the I/O device may be specific to those applications. For example, in those instances, the I/O device may include a laptop computer, a tablet computer, a desktop computer, a phone, a watch, a personal digital assistant, etc. Via the operator I/O device, the controller 140 may provide diagnostic information, a fault or service notification based on one or more determinations. For example, in some embodiments, the controller 140 may display, via the operator I/O device, a temperature of the DOC 121, a temperature of the engine 101 and the exhaust gas, and various other information.

The controller 140 is structured to control, at least partly, the operation of the system 100 and associated sub-systems, such as the aftertreatment system 120 (and various components of each system), and the operator input/output (I/O) device 130. Communication between and among the components may be via any number of wired or wireless connections. For example, a wired connection may include a serial cable, a fiber optic cable, a CAT5 cable, or any other form of wired connection. In comparison, a wireless connection may include the Internet, Wi-Fi, cellular, radio, etc. In one embodiment, a controller area network (CAN) bus provides the exchange of signals, information, and/or data. The CAN bus includes any number of wired and wireless connections. Because the controller 140 is communicably coupled to the systems and components of FIG. 1, the controller 140 is structured to receive data from one or more of the components shown in FIG. 1. The structure and function of the controller 140 is further described in regard to FIG. 2.

The telematics unit 150 may include, but is not limited to, one or more memory devices for storing tracked data, one or more electronic processing units for processing the tracked data, and a communications interface for facilitating the exchange of data between the telematics unit 150 and one or more remote devices (e.g., a provider/manufacturer of the telematics device, a remote computing system associated with one or more components such as a remote server system associated with the engine manufacturer, etc.). In this regard, the communications interface may be configured as any type of mobile communications interface or protocol including, but not limited to, Wi-Fi, WiMax, Internet, Radio, Bluetooth, Zigbee, satellite, radio, Cellular, GSM, GPRS, LTE, and the like. The telematics unit 150 may also include a communications interface for communicating with the controller 140 of the system 100. The communication interface for communicating with the controller 140 may include any type and number of wired and wireless protocols (e.g., any standard under IEEE 802, etc.). For example, a wired connection may include a serial cable, a fiber optic cable, an SAE J1939 bus (which may also be used by the controller to communicate with one or more system components), a CAT5 cable, or any other form of wired connection. In comparison, a wireless connection may include the Internet, Wi-Fi, Bluetooth, Zigbee, cellular, radio, etc. In one embodiment, a controller area network (CAN) bus including any number of wired and wireless connections provides the exchange of signals, information, and/or data between the controller 140 and the telematics unit 150. In other embodiments, a local area network (LAN), a wide area network (WAN), or an external computer (for example, through the Internet using an Internet Service Provider) may provide, facilitate, and support communication between the telematics unit 150 and the controller 140 and/or a remote computing system. In still another embodiment, the communication between the telematics unit 150 and the controller 140 is via the unified diagnostic services (UDS) protocol. All such variations are intended to fall within the spirit and scope of the present disclosure.

Referring now to FIG. 2, a schematic diagram 200 of the controller 140 of FIG. 1 is shown according to an example embodiment. The controller 140 may be structured as one or more electronic control units (ECU). The controller 140 may be separate from or included with at least one of a transmission control unit, an exhaust aftertreatment control unit, a powertrain control module, an engine control module (ECM), etc. In one embodiment, the components of the controller 140 are combined into a single unit. In another embodiment, one or more of the components may be geographically dispersed throughout the system. All such variations are intended to fall within the scope of the disclosure. The controller 140 is shown to include a processing circuit 202 having a processor 204 and a memory device 206, a thermal management circuit 210, a sensor management circuit 212, and a communications interface 216.

In one configuration, the thermal management circuit 210 and the sensor management circuit 212 are embodied as machine or computer-readable media storing instructions that are executable by a processor, such as processor 204. As described herein and amongst other uses, the machine-readable media facilitates performance of certain operations to enable reception and transmission of data. For example, the machine-readable media may provide an instruction (e.g., command, etc.) to, e.g., acquire data. In this regard, the machine-readable media may include programmable logic that defines the frequency of acquisition of the data (or, transmission of the data) among other functionalities. The computer readable media may include code, which may be written in any programming language including, but not limited to, Java or the like and any conventional procedural programming languages, such as the "C" programming language or similar programming languages. The computer readable program code may be executed on one processor or multiple remote processors. In the latter scenario, the remote processors may be connected to each other through any type of network (e.g., CAN bus, etc.).

In another configuration, the thermal management circuit 210 and the sensor management circuit 212 are embodied as hardware units. As such, the thermal management circuit 210 and the sensor management circuit 212 may include one or more circuitry components including, but not limited to, processing circuitry, network interfaces, peripheral devices, input devices, output devices, sensors, etc. In some embodiments, the thermal management circuit 210 and the sensor management circuit 212 may take the form of one or more analog circuits, electronic circuits (e.g., integrated circuits (IC), discrete circuits, system on a chip (SOCs) circuits, microcontrollers, etc.), telecommunication circuits, hybrid circuits, and any other type of "circuit." In this regard, the thermal management circuit 210 and the sensor management circuit 212 may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on). The thermal management circuit 210 and the sensor management circuit 212 may also include programmable hardware devices such as field programmable gate arrays, programmable array logic, programmable logic devices or the like. The thermal management circuit 210 and the sensor management circuit 212 may include one or more memory devices for storing instructions that are executable by the processor(s) of the thermal management circuit 210 and the sensor management circuit 212. The one or more memory devices and processor(s) may have the same definition as provided herein with respect to the memory device 206 and processor 204. In some hardware unit configurations and as described above, the thermal management circuit 210 and the sensor management circuit 212 may be geographically dispersed throughout separate locations in the system. Alternatively and as shown, the thermal management circuit 210 and the sensor management circuit 212 may be embodied in or within a single unit/housing, which is shown as the controller 140.

In the example shown, the controller 140 includes the processing circuit 202 having the processor 204 and the memory device 206. The processing circuit 202 may be structured or configured to execute or implement the instructions, commands, and/or control processes described herein with respect to the thermal management circuit 210 and the sensor management circuit 212. The depicted configuration represents the thermal management circuit 210 and the sensor management circuit 212 as instructions (e.g., machine or computer-readable media) which may be stored by the memory device. However, as mentioned above, this illustration is not meant to be limiting as the present disclosure contemplates other embodiments where the thermal management circuit 210 and the sensor management circuit 212, or at least one circuit of the circuits the thermal management circuit 210 and the sensor management circuit 212, is configured as a hardware unit. All such combinations and variations are intended to fall within the scope of the present disclosure.

The processor 204 may be implemented as one or more processors, an application specific integrated circuit (ASIC), one or more field programmable gate arrays (FPGAs), a digital signal processor (DSP), a group of processing components, or other suitable electronic processing components. In some embodiments, the one or more processors may be shared by multiple circuits (e.g., the thermal management circuit 210 and the sensor management circuit 212 may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure.

The memory device 206 (e.g., memory, memory unit, storage device) may include one or more devices or components (e.g., RAM, ROM, Flash memory, hard disk storage) for storing data and/or computer code for completing or facilitating the various processes, layers and modules described in the present disclosure. The memory device 206 may be communicably connected to the processor 204 to provide computer code or instructions to the processor 204 for executing at least some of the processes described herein. Moreover, the memory device 206 may be or include tangible, non-transient volatile memory or non-volatile memory. Accordingly, the memory device 206 may include database components, object code components, script components, or any other type of information structure for supporting the various activities and information structures described herein.

The communications interface 216 may include any combination of wired and/or wireless interfaces (e.g., jacks, antennas, transmitters, receivers, transceivers, wire terminals) for conducting data communications with various systems, devices, or networks structured to enable in-vehicle communications (e.g., between and among the components of the vehicle) and, in some embodiments, out-of-vehicle communications (e.g., with a remote server such as via the telematics unit). For example and regarding out-of-vehicle/system communications, the communications interface 216 may include an Ethernet card and port for sending and receiving data via an Ethernet-based communications network and/or a Wi-Fi transceiver for communicating via a wireless communications network. The communications interface 216 may be structured to communicate via local area networks or wide area networks (e.g., the Internet) and may use a variety of communications protocols (e.g., IP, LON, Bluetooth, ZigBee, radio, cellular, near field communication). Regarding out-of-vehicle communications, in these situations, the telematics unit depicted may be excluded from the system.

The communications interface 216 may facilitate communication between and among the controller 140 and one or more components of the system 100. For example and as shown in FIG. 2, the communications interface 216 may facilitate communication between and among the controller 140 and the engine 101, the aftertreatment system 120, the sensors 125, and the telematics unit 150. The communications interface 216 may additionally and/or alternatively facilitate communication between and among the controller 140 and other components of the system 100. Communication between and among the controller 140 and the components of the system 100 may be via any number of wired or wireless connections (e.g., any standard under IEEE). For example, a wired connection may include a serial cable, a fiber optic cable, a CAT5 cable, or any other form of wired connection. In one embodiment, a controller area network (CAN) bus provides the exchange of signals, information, and/or data. The CAN bus can include any number of wired and wireless connections that provide the exchange of signals, information, and/or data. The CAN bus may include a local area network (LAN), or a wide area network (WAN), or the connection may be made to an external computer (for example, through the Internet using an Internet Service Provider).

The thermal management circuit 210 is structured to control the operation of the heater 106 based on sensor data (e.g., temperature data, flow rate data, etc.) received from the sensors 125. For example, the thermal management circuit 210 may utilize a command to increase and/or decrease the heat output of the heater 106 by changing the amount of power (e.g., electrical power) provided to the heater 106. More specifically, the thermal management circuit 210 is structured to activate, deactivate, and/or change the heat output of the heater 106 based on the sensor data. For example, the thermal management circuit 210 may adjust the operation of the heater 106 based on sensor data including a flow rate of the exhaust gases flowing through the aftertreatment system 120, a temperature of the aftertreatment system 120 (e.g., one or more components thereof, the exhaust gasses flowing through the aftertreatment system 120 taken at different points along the aftertreatment system 120, and/or other temperatures related to the aftertreatment system 120), and/or other sensor data. In particular and as described herein, the thermal management circuit 210 activates the heater 106 to increase the temperature of the aftertreatment system 120 based on, for example, the temperature of the aftertreatment system 120 being below a target temperature and/or deactivate the heater 106 to decrease the temperature of the aftertreatment system 120 based on, for example, the temperature of the aftertreatment system 120 being above the target temperature. The thermal management circuit 210 may activate, deactivate, and/or adjust power provided to the heater 106 to reach the target temperature to, for example, reduce NOx emissions.

The temperature of the aftertreatment system 120 may change as the exhaust gasses flow through the aftertreatment system 120. More specifically, while the heater 106 heats up the aftertreatment system 120 at a particular location (e.g., upstream of the DOC 121, as shown in FIG. 1), the temperature may change (e.g., increase and/or decrease) as the exhaust gasses flow downstream from the heater 106. Beneficially, the controller 140 (including the thermal management circuit 210) utilizes a plurality of control processes, such as a dual loop feedback/feedforward control process, to control the operation of the heater 106. The controller 140 may generate a control signal (e.g., a PWM signal) to adjust the operation of the heater 106 based on temperature data from one or more of the sensors 125. As a result, even if the temperature of the aftertreatment system 120 changes, the controller 140 is active in helping to maintain the temperature of the aftertreatment system 120 at the target temperature based on the sensor data from the one or more sensors 125. It should be understood that the target temperature may be a dynamic temperature that changes based on one or more operating conditions such as an ambient temperature, an engine load, and/or other operating conditions, and that the controller 140 can maintain the temperature of the aftertreatment system 120 at the target temperature and change the SCR Tin to match a new target temperature, when the target temperature changes. The logic used to control the operation of the heater 106 is described in more detail herein with respect to FIG. 3.

The "temperature" of the aftertreatment system 120 may be an exhaust gas temperature, a component temperature (e.g., the SCR temperature), and/or a combination thereof. The temperature may be determined based on data from one or more of the sensors 125, described above (or directly sensed by the one or more sensors). The temperature of the aftertreatment system 120 may be sensed and/or determined at various locations. The temperature of the aftertreatment system 120 may be based on temperature data acquired by the sensors 125 such that the temperature of the aftertreatment system 120 is sensed and/or determined at or near the location of the sensors (e.g., at various locations within the engine 101 and/or aftertreatment system 120 shown in FIG. 1). In some embodiments, the temperature refers specifically to a temperature of the exhaust gasses at a particular location in the aftertreatment system 120 (e.g., at an inlet of the SCR 123, etc.).

The sensor management circuit 212 is structured to control the operation of the sensors 125. For example, the sensor management circuit 212 may be structured to generate one or more control signals and transmit the control signals to one or more sensors 125 (e.g., to acquire data, etc.). The control signals may cause the one or more sensors 125 to sense and/or detect the sensor data and/or provide the sensor data to the sensor management circuit 212. In some embodiments, the sensor management circuit 212 may be structured to predict and/or estimate the sensor data (e.g., when the sensors 125 are virtual sensors). In any of these embodiments the sensor data may include temperature data, flow rate data, and/or other data related to the operation of the aftertreatment system 120. The sensor management circuit 212 is also structured to receive the sensor data and provide the sensor data to the other components of the controller 140, such as the thermal management circuit 210.

Figure 3:
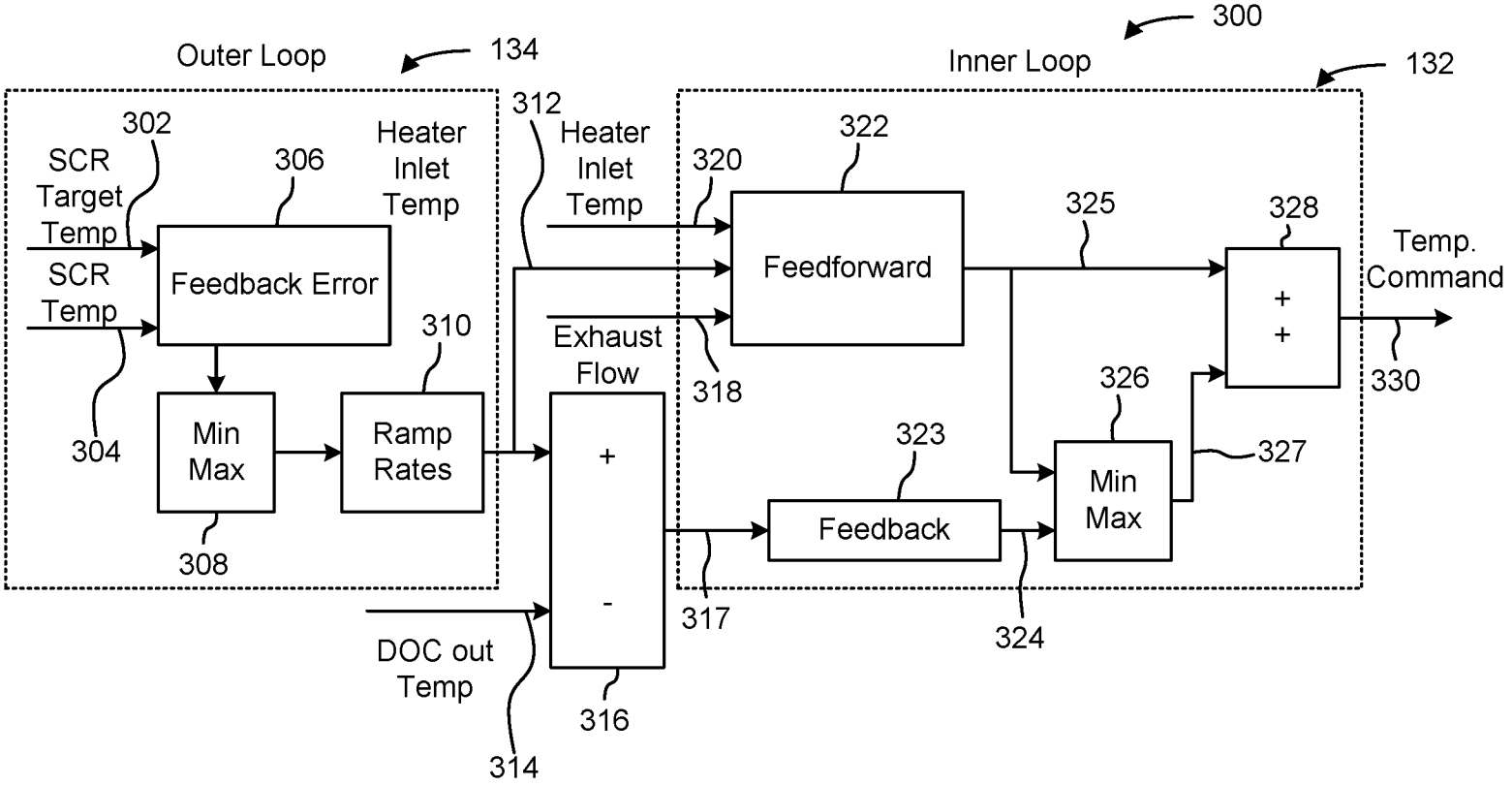
FIG. 3 is a flow diagram of a method of controlling a temperature of a catalyst of the vehicle of FIG. 1, according to an example embodiment.
Figure 4:
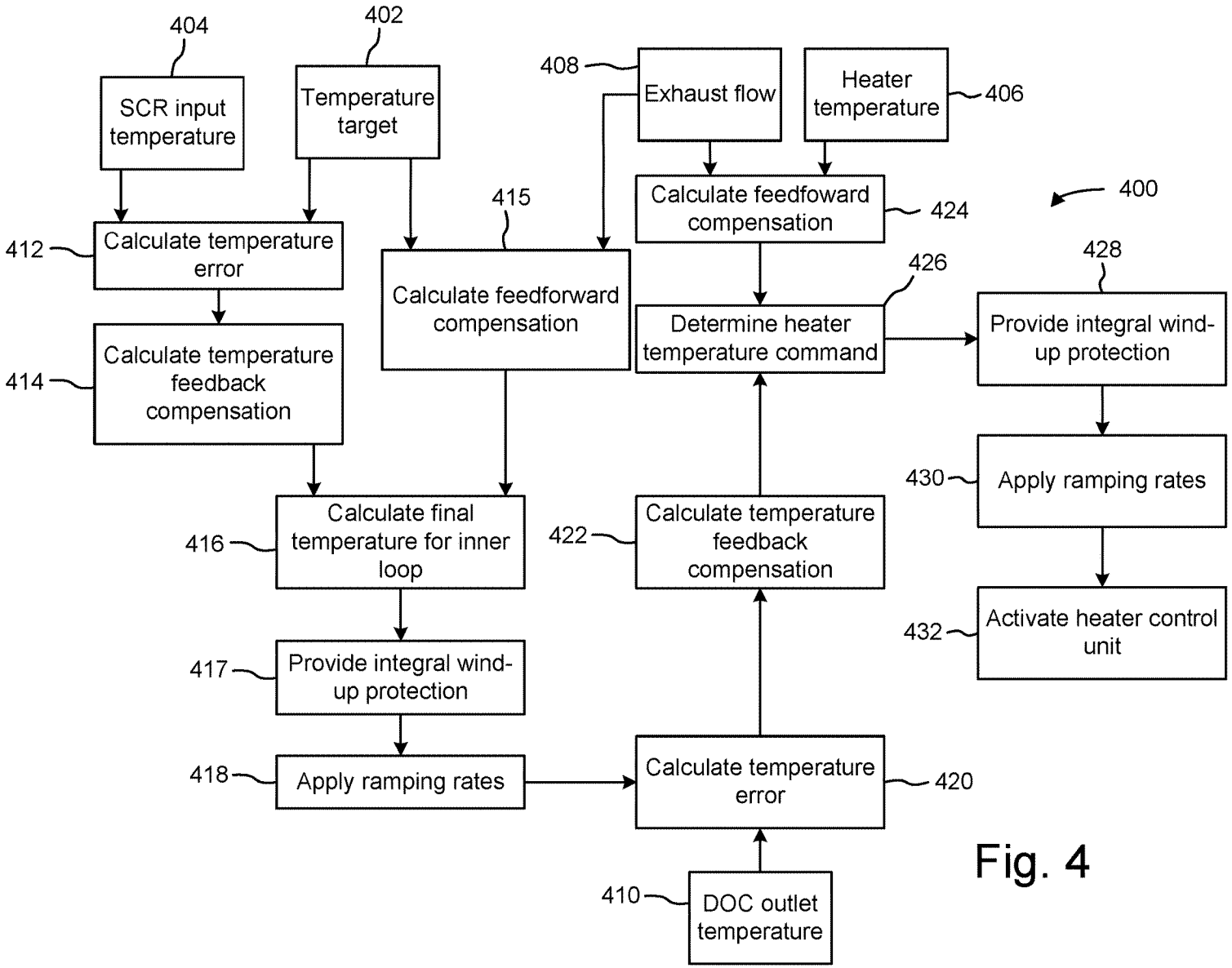
FIG. 4 is a flow diagram of a method of controlling a temperature of a catalyst of the vehicle of FIG. 1, according to an example embodiment.

Referring now to FIGS. 3 and 4, flow diagrams of methods for controlling a temperature of a catalyst of the vehicle of FIG. 1 are shown according to various example embodiments. In the embodiments shown, the controller 140 of FIGS. 1 and 2 is structured to perform the method 300 shown in FIG. 3 and/or the method 400 shown in FIG. 4. It should be understood that aspects of the method 300 shown in FIG. 3 may be combined with aspects of the method shown in FIG. 4, such that the controller may perform the method 300 and the method 400 concurrently, partially concurrently, and/or by using one or more of the processes of the method 300 with one or more of the processes of the method 400, interchangeably.

Referring now to FIG. 3, a flow diagram of a method of controlling a temperature of a catalyst of the vehicle of FIG. 1 is shown, according to an example embodiment. In particular, an example flow chart for a method 300 of determining a power command to output to the heater 106 is depicted. In some embodiments, the controller 140 and/or one or more components thereof is configured to perform method 400. For example, the controller 140 and/or one or more components thereof, may be structured to perform the method 300, alone or in combination with other devices such as the heater 106, the sensors 125, and/or other components of the system 100. The method 300 may include user inputs from a user (e.g., a provider employee, a customer, a vehicle operator, etc.), an input from one or more devices (e.g., user device, other control device of the system 100, etc.), an input from another computing device on the network 105, etc. For example, the controller 140 may receive sensor data from the sensors 125. The sensor data may include a heater temperature (e.g., the DOC inlet temperature), the SCR inlet temperature, and/or the exhaust flow data.

As shown in FIG. 3, the method is divided into a plurality of control processes including a first control processes (e.g. an outer loop 134) and a second control processes (e.g., an inner loop 132). In some embodiments, the first control process is used for controlling the operation of and/or receiving sensor data regarding a first set of components of the aftertreatment system 120 and the second control process is used for controlling the operation of and/or receiving sensor data regarding a second set of components of the aftertreatment system 120. In one exemplary embodiment, the first control process may be specific to the heater 106, the DOC 121, and/or one or more sensors 125. In this exemplary embodiment, the second control process may be specific to the DPF 122, the SCR 123, the DEF 124, and/or one or more sensors 125. In other embodiments, the plurality of control processes may include additional control processes and/or the control processes that may be specific to different components of the exhaust aftertreatment system 120.

Referring now to the first control processes (e.g., the outer loop 134), the controller 140 may execute the first control process that is specific to a first set of components of the exhaust aftertreatment system 120. Executing (i.e., implementing the instructions, commands, logic and/or control processes), by the controller 140, the first control process includes determining a first control process output based on at least sensor data received from the sensors 125 such as the SCR inlet temperature More specifically, at process 306, the controller 140 receives a SCR target temperature 302 and an actual SCR temperature 304. The controller 140 is structured to calculate or determine a feedback error at process 306. The feedback error is defined as the difference between the SCR target temperature 302 and the SCR temperature 304. According to various embodiments, the SCR target temperature 302 may include one or more of a user specified temperature, a target temperature from a lookup table, and/or a temperature specified by a different control system of the system 100, such as a reductant dosing controller. The SCR temperature 304 is the temperature of the aftertreatment system 120 at the inlet of the SCR system 123. The SCR temperature 304 may be sensed and/or determined by one or more of the sensors 125.

At process 308, the controller 140 determines or receives a minimum and/or a maximum value for the heater control output. In some embodiments, the maximum and minimum value for the heater control output is a maximum and/or a minimum heat output (e.g., in BTU, kW, joules, etc.) that the heater 106 is operable to provide. For example, the heater 106 may be operable to provide a range of output temperatures and/or a range of output power or energy under physical constraints of the heater 106 and/or defined by a manufacturer of the heater. In some embodiments, the maximum and minimum heater control output may include a power command based on a maximum and/or a minimum amount of power that the heater 106 is operable to receive, such as a maximum or minimum power value, a maximum or minimum percent duty cycle (e.g., PWM signal), etc. In some embodiments, the maximum and minimum heater output may include a temperature command based on a maximum and/or a minimum temperature that the heater 106 is operable to output, such as a maximum or minimum temperature value, a maximum or minimum percent duty cycle (e.g., PWM signal), etc. for achieving the temperature.

At process 310, the controller 140 receives or determines ramp rates for the heater output. The ramp rate is the rate at which the heater 106 increases or decreases the temperature. The ramp rates may be determined based on, for example, a formulation of the SCR 123. For example, increasing or decreasing the temperature of the exhaust gasses, and thereby the SCR 123, too quickly may cause damage to the SCR 123 and/or a component thereof. That is, the SCR 123 may be sensitive to quick ramp rates. The controller 140 receives or determines the ramp rate by using a lookup table that correlates SCR formulations to ramp rates. More specifically, the controller 140 may identify a ramp rate that corresponds to the formulation of the SCR 123 in the lookup table. The ramp rate may define a threshold (e.g., a maximum) change in temperature for the heater 106. The change in temperature for the heater 106 is defined as a difference between a current heater temperature and a target heater temperature.

At process 310, the controller 140 determines outer loop feedback data 312 (also referred to herein as a "first control process output"). The outer loop feedback data 312 may include a target temperature value for the heater 106 referred to herein as a "heater output temperature target." The heater output temperature target is at temperature value at which the heater 106 needs or likely needs to operate such that a temperature of the downstream SCR 123 is maintained at the SCR target temperature 302. In some embodiments, the heater output temperature target is related to a target DOC outlet temperature (i.e., DOC Tout target). More specifically and in some embodiments, the heater output temperature target is equal to a DOC Tout target. In some embodiments, the controller 140 may cause the heater 106 to operate according to the heater output temperature target.

In some embodiments, controller 140 may determine may determine the heater output temperature target by using a process (e.g., a lookup table), algorithm, and/or the like that correlates the feedback error with a target output temperature for the heater 106. In other embodiments, the controller 140 may use a machine learning model that correlates the feedback error with a temperature target to determine the target output temperature for the heater 106. In some embodiments, the controller 140 may modify the heater output temperature target based on the maximum and/or minimum values determined at process 308 and/or the ramp rate determined at process 310. For example, controller 140 may increase the heater output temperature target to be at or above the minimum value, decrease the heater output temperature target to be at or below the maximum value, and/or decrease the heater output temperature target such that the difference between the heater output temperature target and the current heater temperature is less than the maximum change in temperature for the heater 106.

In some embodiments, the outer loop feedback data 312 includes the modified heater output temperature target. In other embodiments, the outer loop feedback data 312 includes the heater output temperature target, the maximum and/or the minimum value determined a process 308, and/or the ramp rate determined at process 310. As shown in FIG. 3, the outer loop feedback data 312 may be used as an input to the inner loop 132 directly, to process 322, and/or indirectly, to process 316.

At process 316, the controller 140 receives a DOC out temperature 314 (also referred to herein as DOC Tout). The controller 140 may compare the outer loop feedback data 312 with the DOC Tout. At process 316, the controller 140 calculates a temperature error 317. The temperature error 317 is defined as the difference between the outer loop feedback data 312 and the DOC Tout 314. More specifically, the temperature error 317 is a difference between the DOC Tout and the heater output temperature target (e.g., the DOC Tout target). In additional and/or alternative embodiments, the temperature error 317 may be determined for a different component of the aftertreatment system 120. In these embodiments, at process 316, the controller 140 may compare the outer loop feedback data 312 with an aftertreatment system component outlet temperature.

Now referring to the second control process (e.g., the inner loop 132), the controller 140 may execute the second control process that is specific to a second set of components of the exhaust aftertreatment system 120. Executing (i.e., implementing the instructions, commands, logic and/or control processes), by the controller 140, the second control process includes determining a heater control output based on at least one of the first control process output or the sensor data. More specifically, at process 322, the controller 140 receives the outer loop feedback data 312, an exhaust flow value 318 from the one or more sensors 125, and a heater inlet temperature 320 from the one or more sensors 125. The heater inlet temperature 320 is a temperature of the exhaust gas at or near the heater 106. In other embodiments, the heater inlet temperature 320 may be a temperature set point of the heater 106. As described above, the heater inlet temperature 320 is related to the DOC Tin. More specifically, the heater inlet temperature 320 is equal to the DOC Tin. Accordingly, as used herein, the heater inlet temperature 320 is interchangeable with DOC Tin.

At process 322, the controller 140 calculates a feedforward prediction of a temperature (referred to herein as a "feedforward prediction") at which the heater 106 needs or likely needs to operate such that a temperature of the downstream SCR 123 is maintained at the SCR target temperature. The feedforward prediction may be based on a lookup table or, more specifically, a feedforward lookup table that correlates one or more input values (e.g., the heater output temperature target, the target SCR temperature, the SCR inlet temperature, the exhaust flow data, the heater inlet temperature, etc.) with a predicted temperature value. The feedforward lookup table includes empirical models, physics generated models, and/or the like. Additionally and/or alternatively, the feedforward prediction be based on a machine learning or artificial intelligence model. In any of these embodiments, the feedforward prediction is calculated as a function of the outer loop feedback data 312, the heater inlet temperature 320, and the exhaust flow 318. The controller 140 is configured to output an inner loop feedforward data 325 based on the feedforward prediction. The inner loop feedforward data 325 includes information regarding a predicted heater output temperature. Thus, the inner loop feedforward data 325 may include a predicted temperature value for operating the heater 106. In some embodiments, the controller 140 may cause the heater 106 to operate according to the feedforward prediction.

At process 323, the controller 140 calculates or determines a feedback temperature based on the temperature error 317. The "feedback temperature" (also referred to herein as a "temperature feedback compensation") is a target temperature at which the heater 106 needs or likely needs to operate such that a temperature of the downstream SCR 123 is maintained at the SCR target temperature. The feedback temperature is calculated as a function of the temperature error 317. For example, the controller 140 may use a mathematical model, a physics model, or other model, such as a proportional-integral-derivative (PID) control loop, to determine the feedback temperature.

As used herein a PID control loop refers to a control strategy that uses three terms or values (e.g., a proportional term, an integral term, and a derivative term) to automatically control an output. The PID control loop continuously calculates an error value as the difference between a desired set point or target value and a measured or determined output value. The PID control loop applies a correction based on the proportional, integral, and derivative terms.

Referring back to process 323, the controller 140 may continuously calculate the feedback temperature error 317 (e.g., at process 316) as the difference between the heater output temperature target and the DOC Tout. The feedback temperature may be based on a mathematical model, a physics model, or other model. For example, the controller 140 may determine proportional, integral, and derivative terms of a PID control loop such that a PID mathematical model is a function of the temperature error 317. In some embodiments, at process 323, the controller 140 outputs the feedback temperature. In some embodiments, at process 323, the controller 140 outputs an inner loop feedback command 324 that includes the feedback temperature. In some embodiments, the inner loop feedback command 324, or, more specifically, the feedback temperature may be used in later processes to adjust or tune the inner loop feedforward data 325 (e.g., the feedforward prediction determined at process 322). For example, a temperature value of the feedforward prediction 325 may be compared to the feedback temperature to determine if the feedforward predication is overcompensating (e.g., greater than the feedback temperature), undercompensating (e.g., less than the feedback temperature) or compensating as-desired (e.g., equal to the feedback temperature or within a predetermined range of the feedback temperature, such as within 10% or another value of the feedback temperature) for a temperature change across one or more components of the aftertreatment system 120, such as the DOC 121.

At process 326, the controller 140 determines or receives a maximum and/or a minimum value for the heater control output. The maximum and/or minimum values for the heater control output may include maximum and/or minimum power values based on the heater 106 (e.g., a minimum power needed to turn on the heater, a maximum heater power, etc.), maximum and/or minimum percent temperature command values (e.g., between 0% and 100%), and/or other parameters for operation of the heater 106. The controller may output a modified version of at least one of the inner loop feedback data 324 (e.g., the feedback temperature) and the inner loop feedforward data 325 (e.g., the feedforward prediction). The modified version of the inner loop feedback data 324 and/or the inner loop feedforward data 325 may include the maximum and/or minimum values applied. In some embodiments, at process 236, the controller may output a single control signal that combines the inner loop feedback data 324 and the inner loop feedforward data 325, shown as data signal 327. The modified version(s) of at least one of the inner loop feedback data 324 and the inner loop feedforward data 325 and/or the data signal 327 may be used as an input for process 328. In some embodiments, process 326 is optional and the inner loop feedback data 324 (e.g., the feedback temperature) and the inner loop feedforward data 325 (e.g., the feedforward prediction) are used as inputs for process 238.

At process 328, the controller 140 generates a heater control output 330 based on the inner loop feedforward data 325 from process 322 (e.g., the feedforward prediction) and/or the data signal 327 from process 326 (e.g., the feedforward prediction and/or the feedback temperature). The heater control output 330 is at least one of a data signal, a PWM signal, or other control signal that causes the heater 106 to operate. The heater control output 330 is configured to cause the heater 106 to operate according to a target temperature for the heater 106. For example, the heater control output 330 causes the heater 106 to operate by turning on the heater 106, turning off the heater 106, and/or changing an output power of the heater 106 (e.g., by adjusting a duty cycle of the heater 106 or a PWM signal provided to the heater 106).

The inner loop feedforward data 325 includes and/or is associated with the feedforward prediction generated at process 322. The data signal 327 includes and/or is associated with the feedback temperature determined at process 323, the feedforward prediction generated at process 322, and the modification made at process 326. At process 328, the controller 140 uses both the inner loop feedforward data 325 (e.g., the feedforward prediction) and the data signal 327 (e.g., the feedback temperature and/or the feedforward prediction), together, to compensate and finally generate the heater control output 330. For example, the heater control output 330 may be the sum of the command from the feedback logic (e.g., data signal 327) and the feedforward logic (e.g., feedforward data 235). In additional and/or alternative embodiments, the modified version(s) of at least one of the inner loop feedback data 324 and the inner loop feedforward data 325 and/or the data signal 327 may be used as an input for process 328. In any of the above described embodiments, the heater control output may be determined such that the feedback error determined at process 306 is minimized. For example, heater control output 330 may cause the heater 106 to heat more aggressively if the actual DOC Tout (e.g., the DOC out temperature 314) is less than the DOC Tout target (e.g., the outer loop feedback data 312), and/or cause the heater 106 to stop heating when the actual DOC Tout is more than the target DOC Tout.

It should be understood that any of the data described herein, such as the outer loop feedback data 312, the inner loop feedback data 324, the inner loop feedforward data 325, the data signal 327, and/or the heater control output 330 may include information used to determine other control signals. In some embodiments, the data may include information and/or control signals for controlling the operation of one or more components of the aftertreatment system 120. For example, the heater control output 330 may include a control signal sent to a controller of the heater 106 for controlling the heater 106 (e.g., temperature command, a power command, a percent duty cycle signal, a PWM signal, and/or other command for operating the heater 106). The controller 140 may control the heater 106 directly in other embodiments.

Advantageously, the feedforward prediction generated at process 322 and the feedback error determined at process 323 are used to reduce error on the SCR inlet temperature by adjusting the operation of the heater 106 to meet or substantially meet (e.g., within a predefined amount of amount) the SCR target temperature. The method 300 may be iterative such that additional sensor data (e.g., SCR temperature 304, heater inlet temperature 320, exhaust flow 318, DOC Tout 314, etc.) sensed and/or determined may be used to generate updated heater control output 330. The method 300 may be repeated in real-time (e.g., every millisecond, every second, every minute) and/or periodically (e.g., every hour, etc.).

In some embodiments, the controller 140 may output any of the determined values including the feedback error, the maximum and/or minimum value(s) for the heater control output, the ramp rates for the heater output, the outer loop feedback data (e.g., the first control process output or the heater output temperature target), the temperature error, the inner loop feedback command (e.g., the feedback temperature), inner loop feedforward data (e.g., the feedforward prediction), the data signal 327 (e.g., modified and/or unmodified versions of the feedforward prediction and/or the feedback temperature, or the heater output control 330 to a display device, such as the operator I/O device 130 and/or another display device.

Referring now to FIG. 4 a flow diagram of a method of controlling a temperature of a catalyst of the vehicle of FIG. 1, according to an example embodiment. In particular, an example flow chart for a method 400 of determining a command to output to the heater 106 is depicted. In some embodiments, the controller 140 and/or one or more components thereof is configured to perform method 400. For example, the controller 140 and/or one or more components thereof, may be structured to perform the method 400, alone or in combination with other devices such as the heater 106, the sensors 125, and/or other components of the system 100. The method 400 may include user inputs from a user (e.g., a provider employee, a customer, a vehicle operator, etc.) of one or more user devices (such as devices of provider employees, customer, a user device integrated with a vehicle, etc.), another computing device on the network 105, etc.

As an overview of method 400, the controller 140 receives one or more inputs from the sensors 125, a user input from a user (e.g. from the operator I/O device 130 and/or other input device), and/or other inputs related to the aftertreatment system 120. The controller then determines and generates a control signal to send to the heater 106. At process 402, a temperature target input is received by the controller 140. At process 404, a SCR input temperature is received by the controller 140. At process 406 a heater temperature is received by the controller 140. At process 408 an exhaust flow input is received by the controller 140. At process 410, a DOC output temperature is received by the controller 140. A first control process (e.g., the outer loop 134) includes processes 412-418. At the outer loop 134, for example, at process 412 a temperature error is calculated. At process 414 a temperature feedback compensation is calculated. At process 415, a feedforward compensation is calculated. At process 416, a final temperature for the inner loop (e.g., the inner loop 132) is calculated. At process 417, an integral wind-up protection is determined by the controller 140. At process 418, ramping rates are determined by the controller 140. A second control processes (e.g., the inner loop 132) includes processes 420-432. At the inner loop 132, for example, at process 420 a temperature error is calculated. At process 422, a temperature feedback compensation is calculated. At process 424, a feedforward compensation is calculated. At process 426, a heater duty cycle is calculated. At process 428 an integral wind-up protection is determined by the controller 140. At process 430 ramping rates are determined by the controller 140. At process 432, a heater control unit is activated. In some embodiments, the processes of the method 400 may be performed in a different order than as shown in FIG. 4. In some embodiments, the method 400 may include more or fewer processes than as shown in FIG. 4. In some embodiments and as briefly described above, any of the processes of the method 400 may be used in addition to and/or in place of any of the processes of the method 300. In other embodiments, any of the processes of the method 300 may be used in addition to and/or in place of any of the processes of the method 400.

Referring to the method 400 in more detail, at processes 402, the controller 140 determines a target temperature. As briefly described above with respect to FIG. 3, the target temperature may include one or more of a user specified temperature, a target temperature from a lookup table, and/or a temperature specified by a different control system of the system 100, such as a DEF controller, a heater controller, etc. In additional and/or alternative embodiments, the target temperature may be determined based on one or more statistical and/or machine learning models. In any of the embodiments described herein, the target temperature may be based on one or more operating conditions that may define desired operating temperatures for achieving or likely achieving a desired operating characteristic (e.g., NOx conversion efficiency above a predefined threshold), such as an ambient temperature, an engine load, a current SCR Tin temperature, and/or other operating condition related to the aftertreatment system 120.

At process 404, the controller 140 receives an SCR input temperature from one or more of the sensors 125. The controller 140 may receive sensor data including the SCR input temperature from one or more of the sensors 125 (e.g., via the sensor management circuit 212). The sensor data may be generated by one or more of the sensors 125 by directly measuring the SCR input temperature (e.g., by a physical sensor) and/or the controller 140 may determine/estimate the SCR input temperature (e.g., a virtual sensor).

At process 406, the controller 140 receives a heater temperature (e.g., a temperature of exhaust gasses at or near the heater 106) from one or more of the sensors 125. As described above, the heater temperature is equal to the DOC Tin. The controller 140 may receive sensor data including the heater temperature from one or more of the sensors 125 (e.g., via the sensor management circuit 212). The sensor data may be generated by one or more of the sensors 125 by directly measuring the heater temperature (e.g., by a physical sensor) and/or determined/estimated by the controller 140 using one or more pieces of information (e.g., a virtual sensor).

At process 408, the controller 140 receives exhaust flow data from one or more of the sensors 125. The controller 140 may receive sensor data including the exhaust flow data from one or more of the sensors 125 (e.g., via the sensor management circuit 212). The sensor data may be generated by one or more of the sensors 125 by directly measuring the exhaust flow data (e.g., by a physical sensor) and/or estimating the exhaust flow data (e.g., by a virtual sensor and/or a statistical model). The exhaust flow data is or includes information regarding the flow of the exhaust gas within the aftertreatment system 120. For example, the exhaust flow data may include an exhaust flow rate (e.g., a mass flow rate, a volumetric flow rate, etc.) of the exhaust gas. In some embodiments, the exhaust flow data may additionally and/or alternatively include a standard engine out mass flow rate.

Accordingly, at process 404, process 406, and process 410, the controller 140 receives sensor data including a heater temperature (e.g., the DOC inlet temperature), the SCR inlet temperature, and the exhaust flow data.

At process 410, the controller 140 receives a DOC output temperature. The controller 140 may receive sensor data including the DOC output temperature from one or more of the sensors 125 (e.g., via the sensor management circuit 212). The sensor data may be generated by one or more of the sensors 125 by directly measuring the DOC output temperature (e.g., by a physical sensor) and/or by the controller 140 estimating the DOC output temperature (e.g., a virtual sensor). Additionally and/or alternatively, at process 410, the controller 140 may receive an SCR input temperature. As briefly described above, the SCR input temperature is closely related to a DOC outlet temperature due to the spatial proximity of the components. While the method 400 described herein uses the DOC output temperature, it should be understood that the DOC output temperature may be replaced and/or used in combination with the SCR input temperature and/or other related temperatures such as a DPF inlet temperature or a DPF outlet temperature. All such variations are intended to fall within the spirit and scope of the present disclosure.

At process 412, a temperature error is calculated. The controller may use the SCR target temperature and the SCR temperature (e.g., the inputs received at processes 402 and 404) to calculate the temperature error. The temperature error is defined as the difference between the SCR target temperature and the actual SCR temperature.

At process 414, a temperature feedback compensation is calculated. The feedback compensation is determined based on the temperature error calculated at process 412. The feedback compensation may be included in the outer loop feedback data, described herein, with respect to FIG. 3. Accordingly, the outer loop feedback data may include the feedback compensation and/or any of the information related to the outer loop feedback compensation. In some embodiments, the controller 140 may utilize a mathematical model, a physics model, or other model to determine the feedback compensation. For example, the controller 140 may use a proportional-integral-derivative (PID) control loop for determining the feedback compensation. In these embodiments, the controller 140 may continuously calculate an error value (e.g., at process 412) as the difference between the SCR target temperature and the actual SCR temperature. The feedback compensation may be based on proportional, integral, and derivative terms of the PID control loop.

At process 415, a feedforward compensation is calculated. The controller 140 calculates a feedforward prediction of a temperature at which the heater 106 needs or likely needs to operate such that a temperature of the downstream SCR 123 is maintained at or substantially at the SCR target temperature. The feedforward prediction may be based on a feedforward lookup table that correlates at least one of the heater output temperature target, the target SCR temperature, the SCR inlet temperature, the exhaust flow data, or the heater inlet temperature with a predicted temperature value. In some embodiments, the feedforward lookup table includes empirical models, physics generated models, and the like. Additionally and/or alternatively, the feedforward prediction be based on a machine learning or artificial intelligence model. In any of these embodiments, the feedforward prediction determined at process 415 may be based on the target temperature, received at process 402 and/or the exhaust flow data received at process 408. The feedforward compensation is determined based on the temperature target and the exhaust flow. The feedforward compensation may be output as outer loop feedforward data. The outer loop feedforward data may include the feedforward prediction of a temperature at which the heater 106 needs to operate such that a temperature of the downstream SCR 123 is maintained at the SCR target temperature. The feedforward compensation may be an additive compensation, which is added to the feedback compensation and/or a multiplicative compensation, which is multiplied with the feedback compensation. In some embodiments, process 415 is optional and may be omitted from the process At process 416, a final temperature for the inner loop (e.g., the inner loop 132) is calculated. In some embodiments, the final temperature may include the outer loop feedback data and/or the outer loop feedforward data. In these embodiments, the final temperature may include a target temperature for the heater 106 (e.g., the "heater output temperature target"). In some embodiments, the final temperature for the inner loop 132 is a "first control process output." The final temperature may additionally and/or alternatively include a power command for the heater 106 (sixty-percent of maximum power output), a control signal for the heater 106 (e.g., a PWM signal), a combination thereof, and so on.

At process 417, the controller 140 determines an integral wind-up protection value. As briefly described above, the controller 140 may determine the feedback compensation using a mathematical model, a physics model, or other model. For example, the controller 140 may use a PID control loop to determine the feedback compensation. In some embodiments, the integral wind-up protection refers to a situation where a PID control loop is correcting for an error where the SCR target temperature is above the actual SCR temperature. Accordingly, the controller 140 may determine an integral term or value for the PID control loop to prevent over-correction of an error term (e.g., the error determined at process 412). Accordingly, the controller 140 may determine an integral wind-up protection suitable for the heater 106 and based on the error term.

At process 418, ramping rates are received or determined by the controller 140. As described above with respect to FIG. 3, the ramp rate is the rate at which the heater 106 increases or decreases the temperature. The ramp rates may be determined based on, for example, a formulation of the SCR 123. For example, increasing or decreasing the temperature of the exhaust gasses, and thereby the SCR 123, too quickly may cause damage to the SCR 123 and/or a component thereof. That is, the SCR 123 may be sensitive to the quick ramp rates. Accordingly, the controller 140 may determine or receive a ramp rate suitable for the heater 106. Determining and/or receiving the ramp rate is described in greater detail herein with respect to process 310 of FIG. 3. The first control process (the outer loop) may output an outer loop output that includes the final temperature determined at processes 416 and modified at processes 417 and 418.

Now referring to the inner loop 132, at process 420 a temperature error is calculated. The controller 140 may use the outer loop output (e.g., the inner loop final temperature determined at process 416 and modified at processes 417 and 418) and the DOC outlet temperature received at process 410 to calculate the temperature error. Here, the temperature error is defined as the difference between the final temperature determined at process 416 and the DOC Tout.

At process 422, a temperature feedback compensation is calculated. The temperature feedback compensation (also referred to herein as a "feedback temperature") is a target output value for the heater 106 (e.g., a target output temperature, a target output power, etc.). The feedback compensation is determined based on the temperature error calculated at process 420. The feedback compensation may be including in the inner loop feedback data, described herein, with respect to FIG. 3. Accordingly, the inner loop feedback data may include the feedback compensation and/or other data, such as a temperature value, a power value, a control signal (e.g., a PWM signal) for operating the heater. In some embodiments, the controller 140 may utilize a mathematical model, a physics model, or other model to determine the feedback compensation. For example, the controller 140 may use a proportional-integral-derivative (PID) control loop for determining the feedback compensation. In these embodiments, the controller 140 may continuously calculate an error value (e.g., at process 420) as the difference between the final temperature determined at process 416 and the DOC Tout. The feedback compensation of the inner loop feedback data may be based on proportional, integral, and derivative terms.

At process 424, a feedforward compensation is calculated. The controller 140 calculates a feedforward prediction of a temperature at which the heater 106 needs or likely needs to operate such that a temperature of the downstream SCR 123 is maintained at the SCR target temperature. The feedforward prediction may be based on a feedforward construct (e.g., table) that includes empirical models, physics generated models, and the like. Additionally and/or alternatively, the feedforward prediction be based on a machine learning or artificial intelligence model. In any of these embodiments, the feedforward prediction determined at process 424 may be based on one or more of a heater inlet temperature received at process 406, and exhaust flow data received at process 408, and other data available to the controller 140, such as the final temperature for the inner loop 416 (and modified at processes 417 and 418). The feedforward compensation may be included in the inner loop feedforward data, described herein, with respect to FIG. 3. Accordingly, the inner loop feedforward data may include the feedforward compensation and/or other data, such as a temperature value, a power value, a control signal (e.g., a PWM signal) for operating the heater determined based on a predicted temperature of the SCR 123. The feedforward compensation may be an additive compensation, which is added to the feedback compensation and/or a multiplicative compensation, which is multiplied with the feedback compensation.

At process 426, the controller 140 determines a temperature command for the heater 106. The temperature command, may be at least one of a control signal sent to a controller of the heater 106 (e.g., temperature command, a power command, etc.), a percent duty cycle signal, a PWM signal, and/or other command for operating the heater 106. In some embodiments, the temperature command is included in the heater control data, described herein above with respect to FIG. 3. The heater control data, including the temperature command, is determined based on the inner loop feedback data determined at process 422 and the inner loop feedforward data determined at process 424.

At process 428 the controller 140 determines an integral wind-up protection value. As briefly described above, the feedback compensation may be based on a PID control loop. In some embodiments, the integral wind-up protection refers to a situation where a PID control loop is correcting for an error where the SCR target temperature is above the actual SCR temperature. Accordingly, the controller 140 may determine an integral term or value for the PID control loop to prevent over-correction of an error term (e.g., the error determined at process 420). Accordingly, the controller 140 may determine an integral wind-up protection suitable for the heater 106 and based on the error term.

At process 430, ramping rates are determined or received by the controller 140. As described above with respect to FIG. 3, the ramp rate is the rate at which the heater 106 increases or decreases the temperature. The ramp rates may be determined based on, for example, a formulation of the SCR 123. For example, increasing or decreasing the temperature of the exhaust gasses, and thereby the SCR 123, too quickly (e.g., above a threshold rate) may cause damage to the SCR 123 and/or a component thereof. That is, the SCR 123 may be sensitive to the quick ramp rates. Accordingly, the controller 140 may determine or receive a ramp rate suitable for the heater 106. Determining and/or receiving the ramp rate is described in greater detail herein with respect to process 310 of FIG. 3.

At process 432, the controller 140 sends the heater control data, including the temperature command (determined at process 426 and modified at processes 428 and 430), to the heater 106. As described above, in some embodiments, the heater control data may be a temperature value or power value sent to a heater control unit of the heater 106. In other embodiments, the heater control data may be a direct control signal, such as a PWM signal, sent to the heater 106, such that the controller 140 directly controls the heater 106.

In some embodiments, the controller 140 may output any of the determined values including the temperature error(s), the temperature feedback compensation(s), the feedforward compensation(s), the final temperature for the inner loop, the integral wind-up protection value(s), the ramp rate(s), and/or the heater temperature command to a display device, such as the operator I/O device 130 and/or another display device.

Figure 5A:
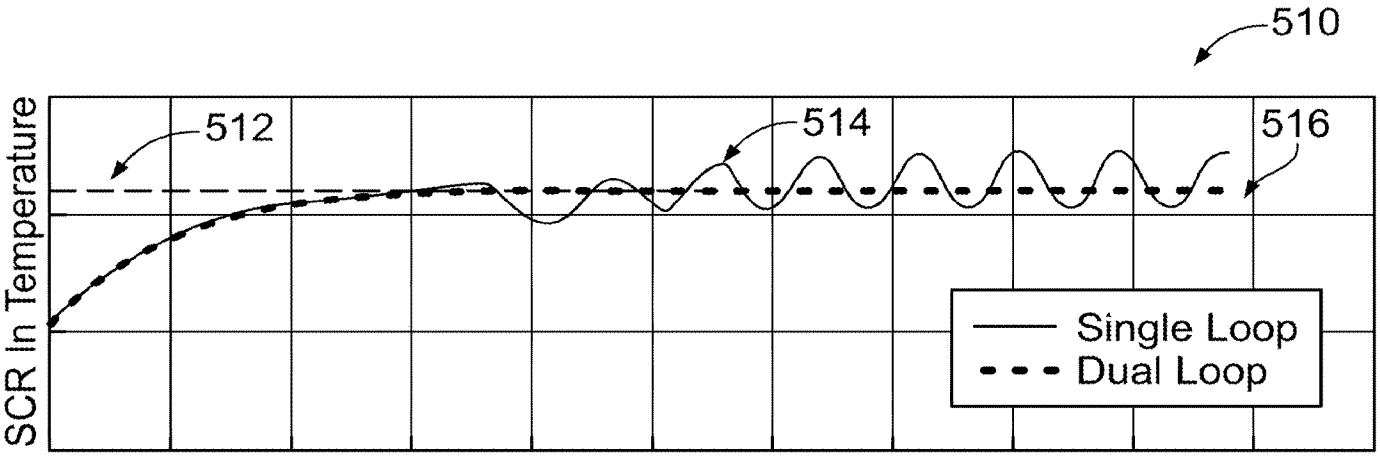
FIGS. 5A and 5B are graphs illustrating aspects of controlling a temperature of a catalyst of the vehicle of FIG. 1, according to example embodiments.
Figure 5B:
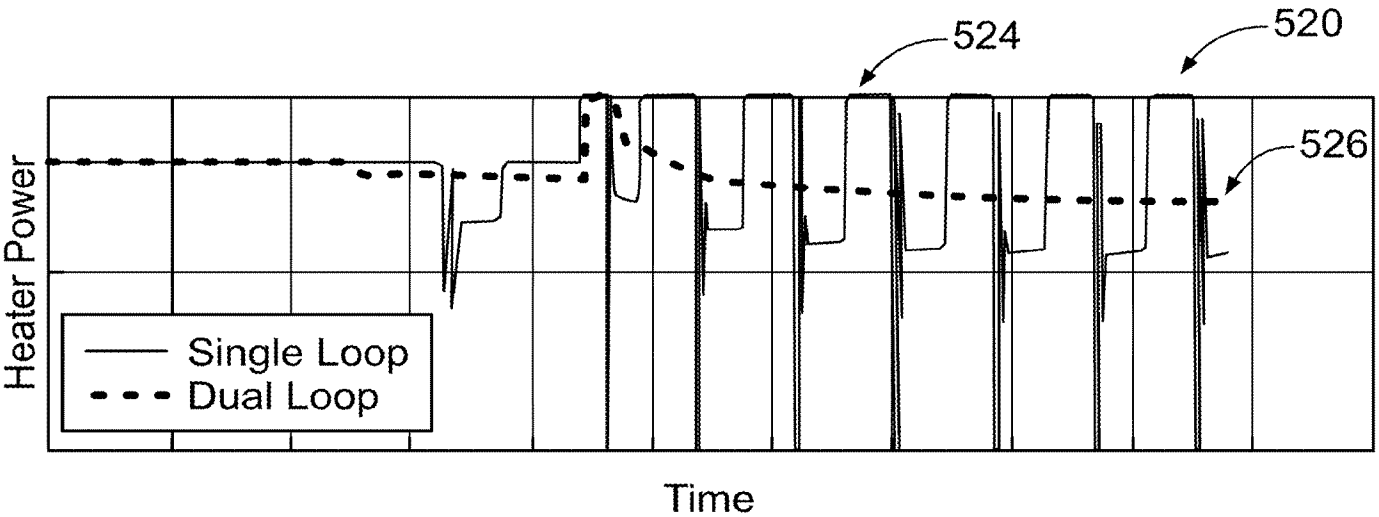

Now referring to FIGS. 5A and 5B, graphs illustrating aspects of controlling the vehicle of FIG. 1 are shown, according to example embodiments. Referring first to FIG. 5A, a graph 510 depicting a SCR inlet temperature versus time is shown, according to an example embodiment. A target SCR temperature line 512, a single loop curve 514, and a dual loop curve 516 are shown. The target SCR temperature line 512 represents a target SCR temperature, as described above. The single loop curve 514 represents the SCR temperature when a single loop or conventional control system is used for controlling an aftertreatment heating system (e.g., the heater 106). The dual loop curve 516 represents the SCR temperature when the dual loop control system described herein is used for controlling an aftertreatment heating system (e.g., the heater 106). As shown, the single loop curve 514 results in repeated under- and over-compensations of heater power, both above and below the target SCR temperature. Conversely, the dual loop control system described advantageously reaches the target SCR temperature monotonically and stays stable thereafter, without overshooting or undershooting the target temperature.

Referring now to FIG. 5B, a graph 520 depicting a heater power versus time is shown, according to an example embodiment. A single loop curve 524 and a dual loop curve 526 are shown. The single loop curve 524 represents the power drawn by an aftertreatment heating system (e.g., the heater 106) when a single loop or conventional control system is used for controlling the aftertreatment heating system (e.g., the heater 106). The dual loop curve 526 represents the power drawn by an aftertreatment heating system (e.g., the heater 106) when the dual loop control system described herein is used for controlling the aftertreatment heating system (e.g., the heater 106). As shown, the single loop curve 514 results in repeated maximum and mime power draws, which may result in heater instability and/or inefficient use of power resources on board the vehicle 100. Conversely, the dual loop control system described advantageously allows for the heater 106 to operate at a more consistent power level, without creating the undesired heater power fluctuations (and thereby the unstable temperature in FIG. 5A).

Thus, by using a plurality of control processes, such as the dual loop feedforward/feedback processes, described herein, the controller 140 is enabled to control the heater output power (e.g., as shown in FIG. 5B, such that the heater output power is more stable.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using one or more separate intervening members, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic. For example, circuit A "coupled" to circuit B may signify that the circuit A communicates directly with circuit B (i.e., no intermediary) or communicates indirectly with circuit B (e.g., through one or more intermediaries).

While various circuits with particular functionality are shown in FIG. 2, it should be understood that the controller 140 may include any number of circuits for completing the functions described herein. For example, the activities and functionalities of the thermal management circuit 210 and the sensor management circuit 212 may be combined in multiple circuits or as a single circuit. Additional circuits with additional functionality may also be included. Further, the controller 140 may further control other activity beyond the scope of the present disclosure.

As mentioned above and in one configuration, the "circuits" may be implemented in machine-readable media for execution by various types of processors, such as the processor 204 of FIG. 2. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network.

While the term "processor" is briefly defined above, the term "processor" and "processing circuit" are meant to be broadly interpreted. In this regard and as mentioned above, the "processor" may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud-based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud-based server). To that end, a "circuit" as described herein may include components that are distributed across one or more locations.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

Accordingly, the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A system, comprising:

an exhaust aftertreatment system coupled to an engine, the exhaust aftertreatment system comprising:
a selective catalytic reduction (SCR) system,
a diesel oxidation catalyst (DOC), and
a heater; and a controller comprising at least one processor coupled to at least one memory device storing instructions that, when executed by the at least one processor, cause the controller to perform operations including:

receiving, from one or more sensors, sensor data comprising a DOC inlet temperature, a SCR inlet temperature, and exhaust flow data;

executing a first control process specific to a first set of components of the exhaust aftertreatment system, the first control process comprising determining a first control process output comprising a heater output temperature target that is at least partly based on at least the SCR inlet temperature;

executing a second control process specific to a second set of components of the exhaust aftertreatment system, the second control process comprising determining a heater control output based on the first control process output that comprises the heater output temperature target and the sensor data; and causing the heater to operate based on the heater control output according to a target SCR temperature.

2. The system of claim 1, wherein the heater is positioned upstream of the DOC.

3. The system of claim 1, wherein executing the first control process further comprises:

determining the heater output temperature target based on the target SCR temperature and the SCR inlet temperature; and causing the heater to operate based on the heater output temperature target.

4. The system of claim 1, wherein executing the second control process further comprises:

receiving a DOC outlet temperature; and determining a feedback temperature based on the first control process output, the DOC outlet temperature, or both;

wherein the heater control output is further based on the feedback temperature.

5. The system of claim 1, wherein executing the second control process further comprises:

receiving a heater inlet temperature;

determining a predicted heater output based on the first control process output, the target SCR temperature, the SCR inlet temperature, the exhaust flow data, the heater inlet temperature, or a combination thereof; and causing the heater to operate according to the predicted heater output.

6. The system of claim 1, wherein executing the second control process further comprises:

receiving a DOC outlet target temperature and a DOC outlet temperature; and determining a feedback temperature based on the DOC outlet target temperature, the DOC outlet temperature, or both;

wherein the heater control output is further based on the feedback temperature.

7. The system of claim 1, wherein executing the first control process further comprises:

receiving a first value and a second value for the heater control output;

modifying the heater output temperature target based on the first value, the second value, or both; and causing the heater to operate based on the modified heater output temperature target.

8. The system of claim 1, wherein executing the first control process further comprises:

receiving a DOC outlet temperature;

modifying the heater output temperature target such that a difference between the heater output temperature target and the DOC outlet temperature is less than a threshold value; and causing the heater to operate based on the modified heater output temperature target.

9. A method, comprising:

receiving, by a controller, sensor data comprising a diesel oxidation catalyst (DOC) inlet temperature, a selective catalytic reduction (SCR) inlet temperature, exhaust flow data, or a combination thereof;

executing, by the controller, a first control process specific to a first set of components of an exhaust aftertreatment system, the first control process comprising determining a first control process output comprising a heater output temperature target that is at least partly based on at least the SCR inlet temperature;

executing, by the controller, a second control process specific to a second set of components of the exhaust aftertreatment system, the second control process comprising determining a heater control output based on the first control process output that comprises the heater output temperature target and the sensor data; and causing, by the controller, a heater to operate based on the heater control output relative to a target SCR temperature.

10. The method of claim 9, wherein executing the first control process further comprises:

determining, by the controller, the heater output temperature target based on the target SCR temperature and the SCR inlet temperature; and causing the heater to operate based on the heater output temperature target.

11. The method of claim 9, wherein executing the second control process further comprises:

receiving, by the controller, a DOC outlet temperature; and determining, by the controller, a feedback temperature based on the first control process output, the DOC outlet temperature, or both;

wherein the heater control output is further based on the feedback temperature.

12. The method of claim 9, wherein executing the second control process further comprises:

receiving, by the controller, a heater inlet temperature;

determining, by the controller, a predicted heater output based on the first control process output, the target SCR temperature, the SCR inlet temperature, the exhaust flow data, the heater inlet temperature, or a combination thereof; and causing the heater to operate according to the predicted heater output.

13. The method of claim 9, wherein executing the second control process further comprises:

receiving, by the controller, a DOC outlet target temperature and a DOC outlet temperature; and determining, by the controller, a feedback temperature based on the DOC outlet target temperature, the DOC outlet temperature, or both;

wherein the heater control output is further based on the feedback temperature.

14. The method of claim 9, wherein executing the first control process further comprises:

receiving, by the controller, a first value and a second value for the heater control output;

modifying, by the controller, the heater output temperature target based on at least one of the first value and the second value; and causing the heater to operate based on the modified heater output temperature target.

15. The method of claim 9, wherein executing the first control process further comprises:

receiving, by the controller, a DOC outlet temperature;

modifying, by the controller, the heater output temperature target such that a difference between the heater output temperature target and the DOC outlet temperature is less than a threshold value; and causing the heater to operate based on the modified heater output temperature target.

16. A non-transitory computer-readable medium storing instructions that, when executed by at least one processor of a controller, cause the controller to perform operations comprising:

receiving sensor data comprising a diesel oxidation catalyst (DOC) inlet temperature, a selective catalytic reduction (SCR) inlet temperature, or exhaust flow data;

executing a first control process regarding a first set of components of an exhaust aftertreatment system, the first control process comprising determining a first control process output comprising a heater output temperature target that is at least partly based on at least the SCR inlet temperature;

executing a second control process regarding a second set of components of the exhaust aftertreatment system, the second control process comprising determining a heater control output based on the first control process output that comprises the heater output temperature target and the sensor data; and causing a heater to operate based on the heater control output according to a target SCR temperature.

17. The non-transitory computer-readable medium of claim 16, wherein the instructions, when executed by the at least one processor of the controller, further cause the controller to perform operations comprising:

determining the heater output temperature target based on the target SCR temperature and the SCR inlet temperature; and causing the heater to operate based on the heater output temperature target.

18. The non-transitory computer-readable medium of claim 16, wherein the instructions, when executed by the at least one processor of the controller, further cause the controller to perform operations comprising:

receiving a DOC outlet temperature;

determining a feedback temperature based on at least one of the first control process output and the DOC outlet temperature;

wherein the heater control output is further based on the feedback temperature.

19. The non-transitory computer-readable medium of claim 16, wherein the instructions, when executed by the at least one processor of the controller, further cause the controller to perform operations comprising:

receiving a heater inlet temperature;

determining a predicted heater output based on the first control process output, the target SCR temperature, the SCR inlet temperature, the exhaust flow data, the heater inlet temperature, or a combination thereof; and causing the heater to operate according to the predicted heater output.

20. The non-transitory computer-readable medium of claim 16, wherein the instructions, when executed by the at least one processor of the controller, further cause the controller to perform operations comprising:

receiving a DOC outlet target temperature and a DOC outlet temperature; and determining a feedback temperature based on at least one of the DOC outlet target temperature and the DOC outlet temperature;

wherein the heater control output is further based on the feedback temperature.

* * * * *